US006880216B2

(12) United States Patent
Ormachea et al.

(10) Patent No.: US 6,880,216 B2
(45) Date of Patent: Apr. 19, 2005

(54) SEAT ASSEMBLY MACHINE WITH INDEPENDENTLY MOVEABLE HEADREST ALIGNMENT

(75) Inventors: Raymond Ormachea, Fraser, MI (US); Robert Bailey, Waterford, MI (US)

(73) Assignee: Automated Solutions, Inc., Shelby Township, MI (US)

( * ) Notice: Subject to any disclaimer, the term of this patent is extended or adjusted under 35 U.S.C. 154(b) by 58 days.

(21) Appl. No.: 10/076,210

(22) Filed: Feb. 14, 2002

(65) Prior Publication Data

US 2002/0112332 A1 Aug. 22, 2002

Related U.S. Application Data

(60) Provisional application No. 60/268,763, filed on Feb. 14, 2001.

(51) Int. Cl.[7] ..... B68G 7/00; B25B 27/14

(52) U.S. Cl. ..... 29/91.5; 29/91.7; 29/91.8; 29/281.1; 29/281.4; 29/281.5; 29/448

(58) Field of Search ..... 29/91, 91.4, 91.5, 29/91.6, 91.7, 281.1, 281.4, 281.5, 448, 91.8, 98

(56) References Cited

U.S. PATENT DOCUMENTS 3,438,108 A * 4/1969 Nash ..... 29/91.5
4,066,027 A * 1/1978 Marforio ..... 112/470.28
4,385,427 A * 5/1983 Fraiser ..... 29/91.5
4,675,962 A * 6/1987 Tillner et al. ..... 29/91.1
5,199,144 A * 4/1993 Abe et al. ..... 29/235
5,287,610 A * 2/1994 Gomolak et al. ..... 29/91.1
5,345,661 A * 9/1994 Hotton et al. ..... 29/91.1
5,365,827 A * 11/1994 Morita ..... 91/1
5,398,393 A * 3/1995 Bentschneider ..... 29/91.5
5,398,482 A * 3/1995 Hessell et al. ..... 53/436
5,457,864 A * 10/1995 Sakaida ..... 29/91.5
5,461,764 A * 10/1995 Hotton et al. ..... 29/91
5,586,377 A * 12/1996 Katsuta et al. ..... 29/91.5
5,603,150 A * 2/1997 Assink et al. ..... 29/91.8
5,688,216 A * 11/1997 Mauriello ..... 482/135
5,774,965 A * 7/1998 Mintz et al. ..... 29/91.5
6,253,435 B1 * 7/2001 Mintz et al. ..... 29/91.5
6,298,532 B1 * 10/2001 Walt, II ..... 29/91
6,434,806 B1 * 8/2002 Walt, II ..... 29/91.5
6,453,529 B1 * 9/2002 Bentschneider ..... 29/91.5
6,629,347 B1 * 10/2003 Bentschneider ..... 29/91.5

* cited by examiner

*Primary Examiner*—Essama Omgba
(74) *Attorney, Agent, or Firm*—Carlson, Gaskey & Olds

(57) ABSTRACT

A seat assembly machine includes an independently adjustable alignment mechanism. A seat holding mechanism secures a seat frame in place relative to a fabric cover that is supported on another portion of the machine. An independently moveable alignment mechanism includes support posts that are received through openings in the cover and into corresponding receiver portions of the seat frame to properly align those components. After proper alignment is verified, the seat frame is inserted into the cover. The adjustment mechanism is normally biased toward the seat frame holding mechanism and movement of the seat frame holding mechanism overcomes the bias on the alignment mechanism so that the alignment mechanism selectively moves with the seat holder mechanism during an assembly process. The independently positionable alignment mechanism facilitates assembling a variety of seat types using a single machine.

22 Claims, 5 Drawing Sheets

SEAT ASSEMBLY MACHINE WITH INDEPENDENTLY MOVEABLE HEADREST ALIGNMENT

CROSS REFERENCE TO RELATED APPLICATIONS

This application claims priority to Provisional Patent Application Ser. No. 60/268,763 filed on Feb. 14, 2001.

BACKGROUND OF THE INVENTION

This invention generally relates to seat assembly machines. More particularly, this invention relates to a machine for assembling vehicle seats having an independently moveable headrest alignment feature.

Typical modern day vehicles include driver and passenger seats having headrests that provide support for an individual's head. Headrests are particularly useful for preventing neck strain or injury as a result of a collision, for example.

Typical seat arrangements include a seat frame that provides support for an individual. The seat frame typically is covered by a cushion and a fabric covering. The headrest typically has two support posts that are received within corresponding portions of the seat frame. The covering over the seat typically has premade holes through which the headrest posts are inserted.

One challenge in making vehicle seats is properly aligning the openings in the seat frame and the openings in the seat cover material and maintaining that alignment during assembly so that the assembled arrangement has the openings properly aligned as needed for eventually inserting the headrest support posts. Various machines have been utilized to assemble seats that incorporate design features for aligning the frame openings and the cover openings. One drawback associated with most machines is that they do not consistently provide accurate alignment. This results in sometimes poorly aligned covers over the seat back which renders a particular unit unuseable in a vehicle. Under some circumstances the seat back can be removed from the fabric cover but this is a time-consuming and, therefore, expensive process. Under other conditions, it is not worth attempting to remove the seat back from the cover so that the unit is discarded. In either situation, there is waste and a loss of economies in production.

Typical assembly machines that include a headrest alignment feature have the headrest alignment structure fixed relative to a seat clamping structure so that the two only move together before or during an assembly process. While such arrangements provide for enhanced accuracy, there are difficulties associated with them. It is not always easy for an operator to ensure proper alignment during the seat assembly process. Additionally, such machines are only capable of handling a specific type of seat frame. If a different seat frame were used, the machine would need to be adjusted, which typically would require at least temporarily removing the machine from production and incurring labor costs for making adjustments to the machine setup to accommodate another seat design. Moreover, some seat frames have a headrest incorporated into the seat so that a separate headrest with posts is not necessary. Such seat frames cannot be accommodated in the machines that have a fixed headrest alignment feature.

There is a need for an improved seat assembly machine that is versatile and enhances accuracy. This invention addresses those needs while avoiding the shortcomings and drawbacks of the prior art.

SUMMARY OF THE INVENTION

In general terms, this invention is a seat assembly machine that has a headrest alignment feature that is independently adjustable relative to other portions of the machine.

One example machine designed according to this invention includes a support frame. A seat frame holding mechanism is moveably supported by the support frame so that it can be selectively moved relative to the support frame to complete a seat assembly process. The seat frame holding mechanism includes a clamping member that secures a selected portion of the seat in position for the assembly process. A mover mechanism selectively moves the first mechanism during the seat assembly process. An alignment mechanism is moveable relative to the support frame independent of the seat frame holding mechanism. A biasing mechanism operates to bias the alignment mechanism in a direction toward the seat frame holding mechanism. The alignment mechanism includes at least one alignment member that is adapted to protrude through an opening in a cover for the seat and a corresponding opening in the seat frame. A plurality of supports hold the seat cover in position so that the seat frame and cushion can be stuffed into the cover in a reverse stuffing operation. The bias provided by the biasing mechanism is overcome by the moving force of the mover mechanism so that the alignment mechanism moves with the seat frame holding mechanism during the seat assembly process. The alignment mechanism is selectively moved into a position to provide alignment between the seat cover and the seat frame and is capable of moving independently of the first mechanism and the mover mechanism.

In one example, the alignment mechanism has a base with two posts that are adapted to protrude through two openings in a seatback cover. The two posts are adapted to be received into corresponding openings on the seat frame to ensure proper alignment of the seat frame and cover before the seat frame is inserted into the cover.

In one example, the alignment member is supported on a carriage and moves with the carriage. The alignment member in one example has a second degree of freedom in that it is partially selectively moveable relative to the carriage.

An operator switch preferably is provided that allows the operator to control the independent movement of the alignment member relative to the remainder of the machine. In one example, the alignment member is selectively placed into a position where it is out of the way and not used so that seat assembly can be completed for seats that have a headrest already incorporated into the seat frame. With such seats, the alignment issues otherwise presented are not of a concern.

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
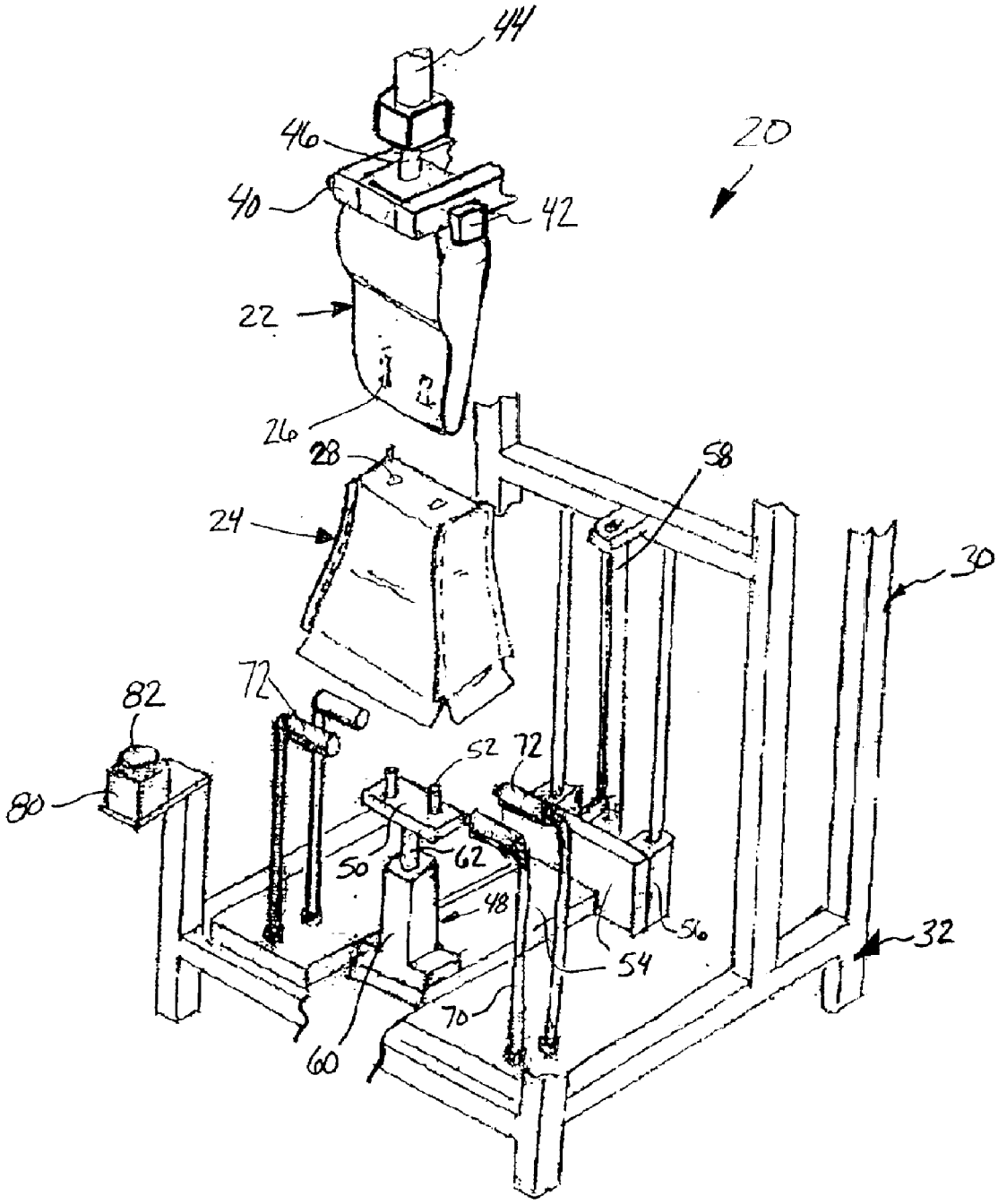
FIG. 1 diagrammatically illustrates, in perspective, exploded view, selected portions of a machine designed according to this invention.
Figure 2:
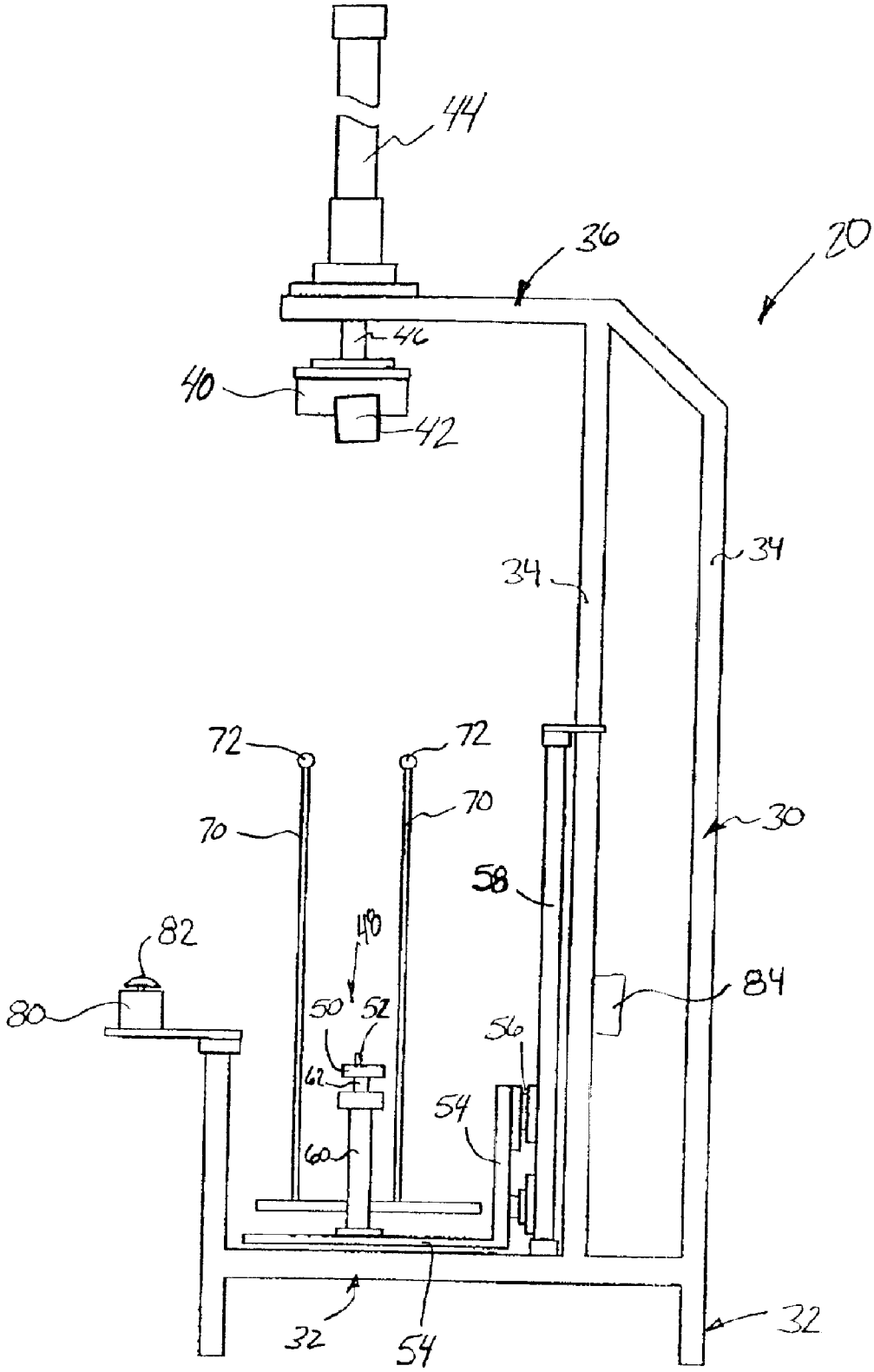
FIG. 2 is a side view of the embodiment of FIG. 1.
Figure 3:
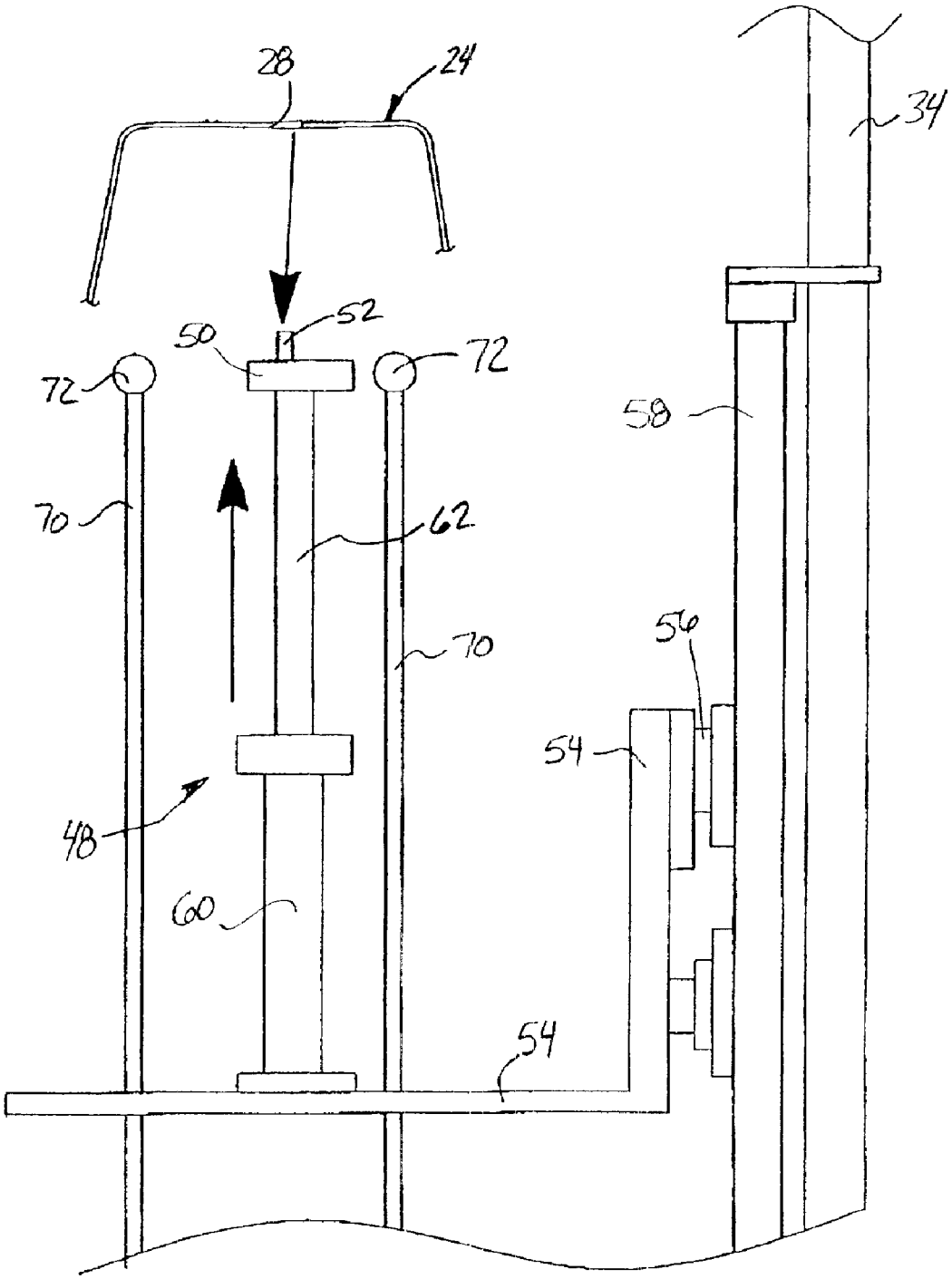
FIG. 3 is a side view of selected portions of the embodiment of FIG. 1.

Referring initially to FIGS. 1 and 2, a seat assembly machine 20 is useful for assembling a seat frame portion 22 with a finish fabric cover 24. The illustrated machine is particularly useful for using a so-called reverse stuffing operation to insert the seat frame 22 into the fabric cover 24. The seat frame 22 includes a support frame and cushion as known in the art. The seat frame includes two receivers 26 that receive support posts from a corresponding headrest (not illustrated) as known in the art. The fabric cover 24 includes two openings 28 through which the headrest posts are eventually inserted. Such seat frames and fabric covers are well known in the art.

The seat assembly machine 20 includes a support frame 30 having a base portion 32, vertical support members 34 and an upper support portion 36. In one example, the support frame 30 is made from steel tubing.

The upper support portion 36 of the frame 30 supports a seat frame holding mechanism 40. A pair of clamp members 42 (only one is visible in the illustrations) operate to secure the seat frame 22 to the seat frame holder 40. A mover device 44, such as a conventional, pneumatic cylinder arrangement selectively causes the seat frame holder 40 to move relative to the frame 30 during the seat assembly operation. Other example devices useful as a mover device include a hydraulic cylinder arrangement or a gas spring. As can be appreciated from the drawings, a shaft 46 moves out of a cylinder of the mover device 44 as the seat frame 22 is pushed downward according to the drawings. This can be appreciated by comparing FIGS. 4 and 5, for example. The mover device 44 preferably comprises commercially available, conventional components. a variety of moving mechanisms may be used in a machine designed according to this invention. Those skilled in the art who have the benefit of this description will be able to select appropriate components to meet the needs of their particular situation.

An alignment mechanism 48 facilitates properly aligning the openings 28 on the fabric cover 24 with the receivers 26 in the seat frame 22. The alignment mechanism 48 includes a support plate 50 upon which two alignment posts are securely positioned. The alignment posts 52 preferably are set at a distance that corresponds to the distance between the openings 28 and the receivers 26, respectively. During the assembly process, the posts 52 are received through the openings 28 on the fabric and at least partially into the receivers 26 on the seat frame so that a proper alignment of those components is achieved.

The alignment mechanism 48 is supported on a carriage 54 that is moveable relative to the frame 30. The illustrated example includes carriage support members 56 that facilitate a biasing device 58 biasing the carriage 54 toward the seat frame holder 40 (i.e., upward according to the drawings). In one example, the biasing device 58 is a pneumatic cylinder arrangement as known in the art. A variety of biasing arrangements are within the scope of this invention. Those skilled in the art who have the benefit of this description will be able to select appropriate components to meet the needs of their particular situation.

The alignment mechanism 48 in the illustrated example is also selectively adjustable relative to the carriage 54. The illustrated arrangement includes a telescoping cylinder having portions 60 and 62 so that the position of the support plate 50 relative to the carriage 54 is selectively moveable to a number of possible positions between two extremes. The cylinder arrangements in the illustrated example include a pneumatic cylinder as known in the art. A variety of adjustment mechanisms may be included to selectively adjust the position of the support plate 50 relative to the carriage 54.

A plurality of fabric supports 70 are supported by the frame 30 so that they are in position to hold the fabric cover 24 in place prior to the assembly operation. A plurality of rollers 72 are supported on ends of the support members 70 to facilitate insertion of the seat frame 22 into the fabric cover 24. As known in the art, the fabric cover 24 preferably is turned inside out prior to assembly. The fabric cover 24 is conveniently placed over the supports 70 during the seat assembly process.

The illustrated example includes manually operable controls 80 having switches 82 that are selectively operated by a user of the machine to control movement of the various portions of the machine. The controls 80 can be made from conventional components. In one example arrangement, one control 80 selectively controls movement of the mover 44 while a second control controls independent movement of the carriage 54 relative to the support frame 30 by adjusting the biasing device 58. Another control may be included to separately control movement of the support plate 50 relative to the carriage 54. Depending on the needs of a particular situation, multiple controls can be included to provide a machine operator with the desired amount of freedom to selectively move and align the various portions of the machine 20.

Figure 4:
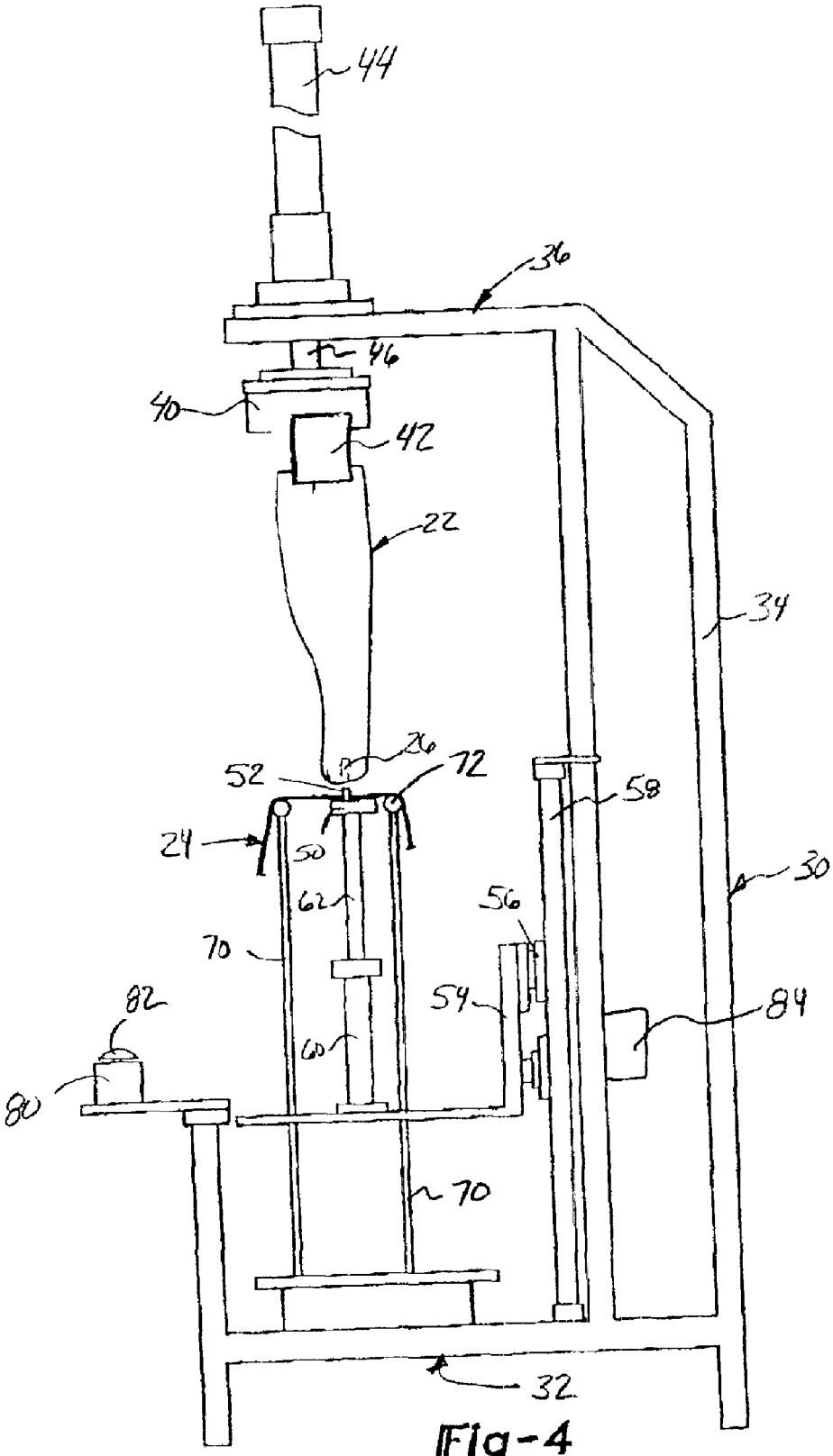
FIG. 4 is a side view showing an early stage of a seat assembly operation using the inventive machine.
Figure 5:
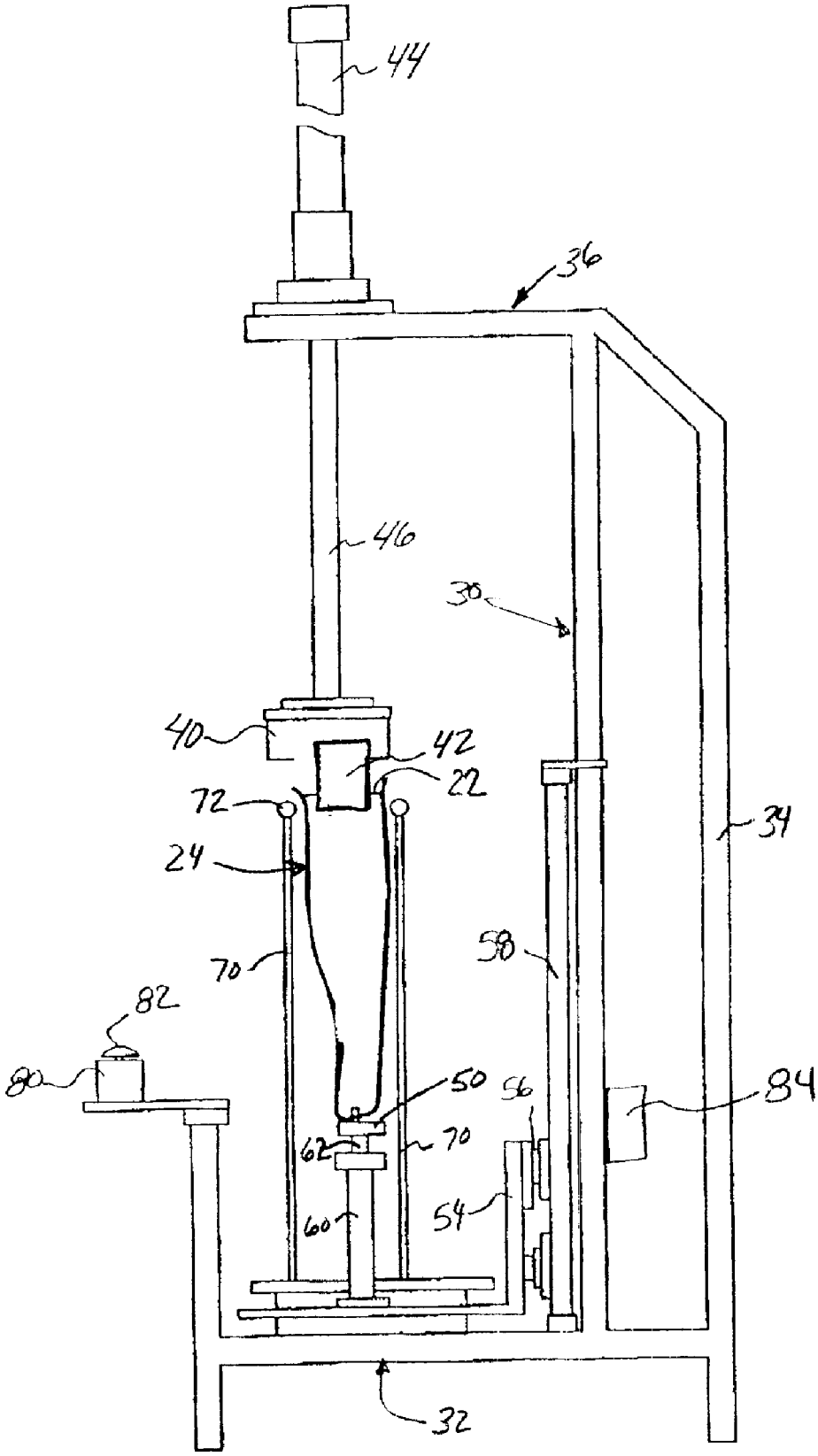
FIG. 5 is a side view illustration of a later stage of the seat assembly operation.

Referring to FIGS. 4 and 5, an example seat assembly process is illustrated. As shown in FIG. 4, the fabric cover 24 preferably is draped over the supports 70 with the alignment posts 52 protruding through the openings 28 in the fabric cover 24. The seat frame 22 preferably is secured into place by the clamping members 42 with the headrest post receivers 26 facing toward the alignment posts 52. Once the alignment posts 52 are at least partially received within the receiver portions 26, proper alignment is achieved. The mover mechanism 44 preferably is then activated and begins moving the seat frame 22 into the cover 24 (i.e., downward according to the drawings). As the seat frame 22 moves down into the cover 24, the cover rolls upon the rollers 72 and is effectively wrapped over the seat frame 22. This so-called reverse stuffing operation provides a secure placement of the seat frame 22 within the cover 24.

As the moving mechanism 44 causes the seat holder portion 40 to move downward (according to the drawings), the bias of the biasing device 58 is overcome by the force of the mover mechanism 44 so that the carriage 54 moves relative to the frame 30 responsive to movement of the seat frame 22. A pressure regulator mechanism 84 is shown in the illustrated example that releases pressure from an air cylinder in the biasing device 58 responsive to the force of the first mover mechanism 44. The pressure regulating mechanism 84 can comprise conventional components. Depending on the chosen biasing member 58, the pressure regulator may be otherwise considered a release mechanism that selectively releases at least a portion of the bias provided by the biasing member 58 responsive to the moving force of the first moving mechanism 44.

In the illustrated example, the telescoping arrangement of the alignment mechanism 48 temporarily collapses responsive to the force of the mover 44. Eventually, the carriage 54 bottoms out on the frame 30. This is timed so that the seat frame 22 is fully inserted in the cover at or by this point in the process.

After the seat frame 22 is fully received within the fabric cover 24, the moving mechanism 44 retracts the shaft 46 causing the seat holder 40 to move back to the initial position shown in FIG. 4. At that point, the covered seat frame is released by releasing the clamping members 42 and another seat assembly process can be completed.

A significant advantage to this invention is that the alignment mechanism is independently moveable relative to the mechanism that is responsible for holding the seat frame in position. The independent moveability allows an operator more freedom in accurately aligning the openings 28 in the cover 24 and the receiver portions 26 and the seat frame 22.

Moreover, the inventive machine is readily capable of being used to assemble a variety of seat types. Changes in the dimensions to the seat frame are readily accommodated because of the independent adjustability of the alignment mechanism 48. The inventive machine further is capable of allowing a reverse stuffing operation to be completed on a seat frame that does not have a separate headrest assembly. The position of the support plate 50 shown in FIG. 2 is one example position where the alignment mechanism 48 is not used for a seat covering operation. The diversity and adjustability features of the inventive arrangement provide a time-saving, more accurate and more economical approach to assembling vehicle seats.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A machine for assembling seats for use in vehicles that have a seat frame supporting a cushion covered by a finish fabric, comprising:

a seat frame holder having at least one clamping member that secures the seat frame in a chosen orientation;

a mover that selectively causes movement of the seat frame holder;

an alignment portion having at least one alignment member that is adapted to protrude through an opening in the fabric and to be at least partially received within a receiver in the seat frame, the alignment member operating to align the opening and the receiver, the alignment portion being moveable independent of and relative to the seat frame holder; and a biasing device that biases the alignment portion toward the seat frame holder, the bias of the biasing device being passively released and overcome by the force of the mover moving the seat frame holder such that the alignment portion selectively moves with the seat frame holder.

2. The machine of claim 1, wherein the alignment portion comprises a support plate and including two post alignment members supported on the support plate.

3. The machine of claim 1, wherein the alignment portion is supported on a carriage that is moveably supported for selective movement relative to the seat frame holder, the carriage is also moveable with the holder responsive to movement of the holder.

4. The machine of claim 3, wherein the biasing device comprises a pneumatic cylinder that biases the carriage toward the seat holder.

5. The machine of claim 4, including a pressure regulator that regulates a bias provided by the biasing device, the pressure regulator automatically releasing pressure from the pneumatic cylinder responsive to the force of the mover moving the seat holder.

6. The machine of claim 5, including a manually operable control that allows an operator to selectively adjust the bias of the biasing device by controlling the pressure regulator.

7. The machine of claim 1, including at least one manually operable control that allows an operator to selectively adjust a position of the alignment portion relative to the seat holder.

8. The machine of claim 1, including a carriage supporting the alignment portion, the carriage being biased by the biasing device, and wherein the alignment portion is selectively adjustable relative to the carriage.

9. The machine of claim 1, wherein the biasing device is selectively controlled to remove any bias and the alignment portion is selectively moveable out of an operative position relative to the seat holder such that the alignment portion is selectively not used for a seat assembly process.

10. The machine of claim 1, including a base that remains a fixed distance from a floor surface and a plurality of supports arranged to at least temporarily support the finished fabric, the supports each having an end distal from the base that remains a fixed distance from the base.

11. A machine for assembling seats for use in vehicles that have a seat frame supporting a cushion covered by a finish fabric, comprising:

a base that remains a fixed distance from a floor surface;

a plurality of fabric cover supports arranged to at least temporarily support the fabric cover in a position to receive the seat frame, the supports each having an end that remains a fixed distance from the base;

a seat holder having at least one clamping member that secures the seat frame in a chosen orientation relative to the fabric cover supports;

a mover that selectively causes movement of the seat frame holder; and an alignment portion having at least one alignment member that is adapted to protrude through an opening in the fabric and to be at least partially received within a receiver in the seat frame, the alignment member operating to align the opening and the receiver, the alignment portion being moveable independent of and relative to the seat frame holder.

12. The machine of claim 11, including a control for selectively operating the mover to cause the seat holder to move relative to the supports such that the seat frame is inserted into the fabric cover.

13. The machine of claim 12, including a control to independently control a position of the alignment portion relative to the supports.

14. The machine of claim 11, including a carriage that supports the alignment portion and wherein the biasing device is operative to selectively bias the carriage toward the seat holder.

15. The machine of claim 14, wherein the alignment member is selectively moveable relative to the carriage.

16. The machine of claim 11, including a biasing device that biases the alignment portion toward the seat frame holder, the bias of the biasing device being overcome by the force of the mover moving the seat frame holder such that the alignment portion selectively moves with the seat frame holder.

17. The machine of claim 16, wherein the biasing device comprises a pneumatic cylinder that biases the carriage toward the seat holder and including a pressure regulator that regulates a bias provided by the biasing device, the pressure regulator automatically releasing pressure from the pneumatic cylinder responsive to the force of the mover moving the seat holder.

18. The machine of claim 17, including a manually operable control that allows an operator to selectively adjust the bias of the biasing device by controlling the pressure regulator.

19. The machine of claim 11, wherein the alignment portion includes a support plate and including two post alignment members supported on the support plate, the posts being adapted to protrude through two fabric openings and to be at least partially received into two receivers in the seat frame.

20. The machine of claim 11, wherein the biasing device is selectively controlled to remove any bias and the alignment portion is selectively moveable out of an operative position relative to the seat holder such that the alignment portion is selectively not used for a seat assembly process.

21. The machine of claim 11, including a first manually operable control for selectively energizing the mover and a second manually operable control for selectively adjusting a position of the alignment portion relative to the seat holder.

22. The machine of claim 11, including a biasing device that biases the alignment portion toward the seat frame holder, the bias of the biasing device being passively released responsive to the force of the mover moving the seat frame holder such that the alignment portion selectively moves with the seat frame holder.

* * * * *